US006260838B1

(12) United States Patent
Coombs

(10) Patent No.: US 6,260,838 B1
(45) Date of Patent: Jul. 17, 2001

(54) STAPLING STACKER

(75) Inventor: Peter M. Coombs, Tustin, CA (US)

(73) Assignee: Gradco (Japan) Ltd., Tokyo (JP)

( * ) Notice: Subject to any disclaimer, the term of this patent is extended or adjusted under 35 U.S.C. 154(b) by 0 days.

(21) Appl. No.: 09/280,599

(22) Filed: Mar. 29, 1999

(51) Int. Cl.[7] ..... B65H 39/10

(52) U.S. Cl. ..... 270/58.12; 270/58.08; 270/58.27; 271/218; 399/404

(58) Field of Search ..... 270/52.18, 58.12, 270/58.07, 58.08, 58.17, 58.27; 399/404, 408, 410; 271/218

(56) References Cited

U.S. PATENT DOCUMENTS 4,905,979 * 3/1990 Limbach et al. ..... 271/218
5,002,456 * 3/1991 Gosslinghoff ..... 271/218
5,544,583 * 8/1996 Banike ..... 270/58.17
5,639,078 * 6/1997 Mandel et al. ..... 270/58.12
5,857,670 * 1/1999 Jung ..... 270/58.12
5,918,871 * 7/1999 Saito et al. ..... 270/58.08

* cited by examiner

*Primary Examiner*—H. Grant Skaggs
(74) *Attorney, Agent, or Firm*—Newton H. Lee, Jr.

(57) ABSTRACT

A stapling stacker has a sheet infeed, a pivoted shelf on which the trailing ends of sheets are assembled with the leading ends supported by previously stacked sets, the sets are side edge aligned, stapled into sets and offset with respect to previously stapled sets, and the shelf then is operated to dump the trailing ends onto previously stapled sets of sheets on the stacker.

14 Claims, 5 Drawing Sheets

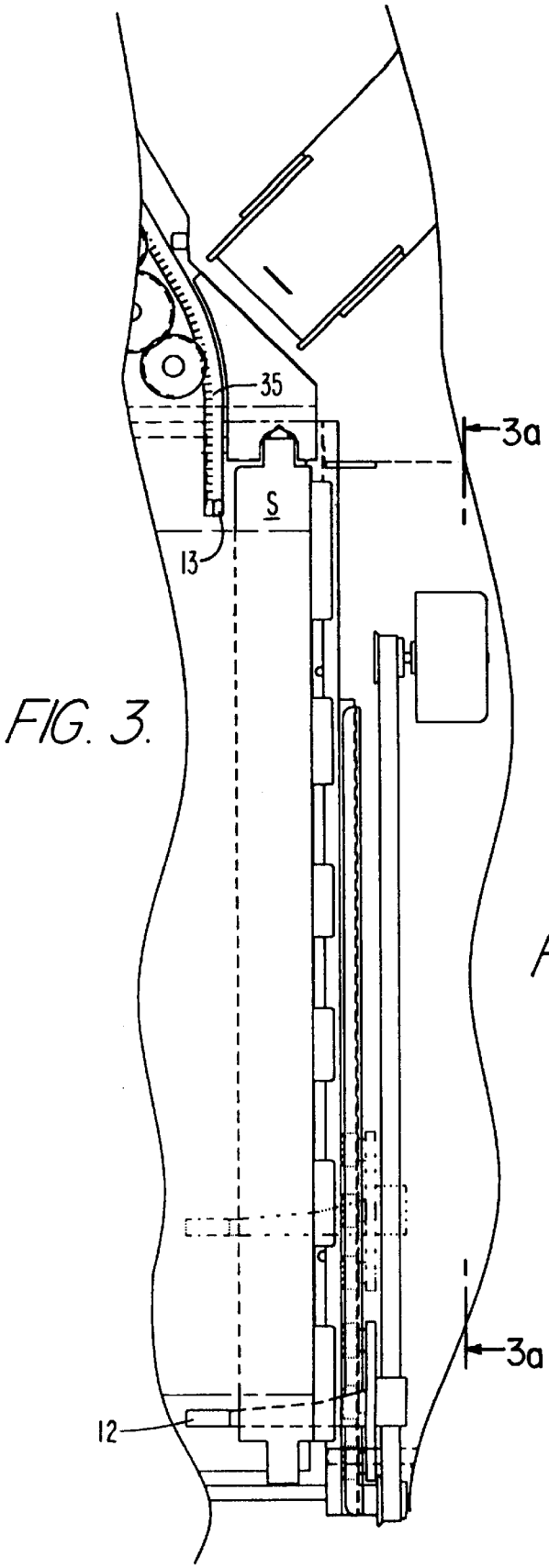
FIG. 3.
FIG. 3b.
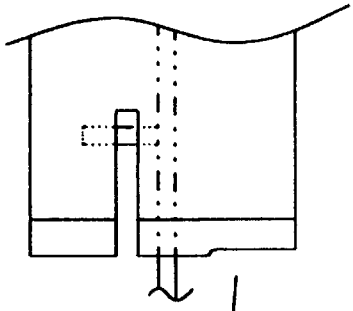
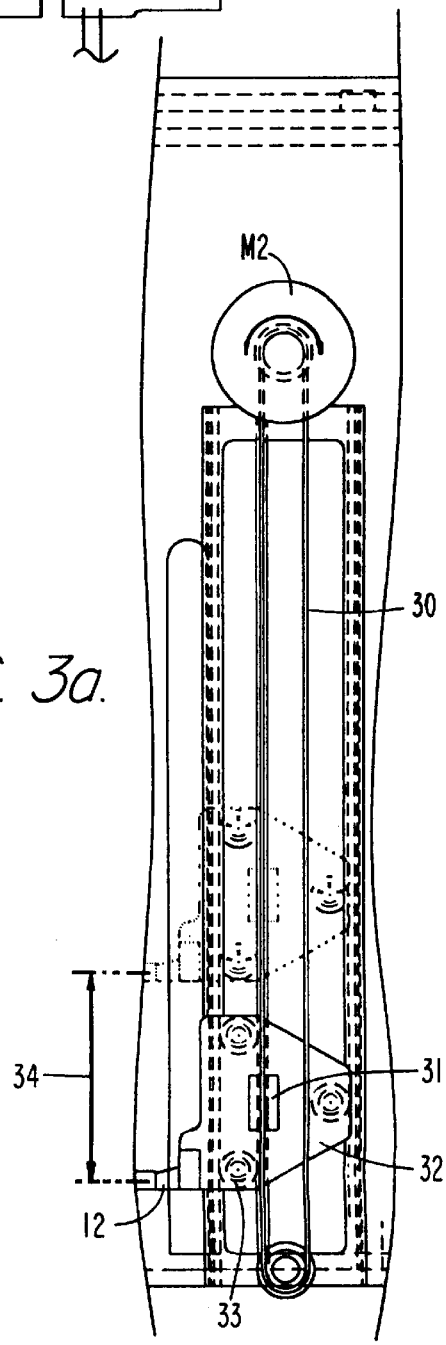
FIG. 3a.

STAPLING STACKER

BACKGROUND OF THE INVENTION

In the prior art there exist examples of paper receiving apparatus which assemble and finish a stapled set of sheets by means which in a preliminary stage assembles the trailing ends of sheets on a shelf, while the leading ends of the sheets are otherwise supported.

Examples of such prior art are seen in Canon U.S. Pat. No. 5,385,340, granted Jan. 31, 1995 and Lawrence U.S. Pat. No. 5,649,695, granted Jul. 22, 1997.

In the Canon structure, the set of sheets is supported at its trailing end on a fixed shelf from which the assembled set is pushed to a receiver.

In the Lawrence structure, the assembled set of sheets is gripped and moved to a finishing station after accumulation of the trailing ends of the sets on a movable shelf.

The pending application, Ser. No. 09/078,202, filed May 14, 1998 is co-owned herewith and discloses a stacker with which are associated a binding station and a stapling station. In that application there is also disclosed a shelf which receives the trailing ends of sheets being accumulated for processing at either of the binding or stapling stations, wherein the shelf is allowed to pivot downwardly to drop the trailing ends of the accumulated set of sheets.

SUMMARY OF THE INVENTION

An object of the present invention is to provide a sheet post processing apparatus in which the sheets are formed in a set on a shelf which is automatically moved or dropped from beneath the trailing end of a set, and wherein, prior to dropping the shelf, the sheets are side edge aligned, registered and stapled.

More specifically, it is an object of the invention to perform the side edge alignment, registration and stapling, as well as offsetting the stapled sets prior to dropping the shelf from beneath the finished set.

In accomplishing the above objectives, the apparatus includes a sheet infeed which receives printed sheets exiting from a copier or printer, a receiving tray for the sheets, a shelf located between the sheet infeed and the tray onto which shelf the trailing ends of sheets are fed, with the leading ends of the sheets supported on the receiving tray or previous set of sheets, thereby assembling a set of sheets for stapling.

The assembled sheets are jogged with side edge alignment between a side edge aligner and a registration member, and may be stapled and offset, following which the shelf drops to release the trailing ends of the set onto the receiving tray or previous set.

In the form shown herein, the receiving tray is a simple stacker spring balanced to support the increasing weight of successive height of finished sets.

A better understanding of the invention will be had by reference to the accompanying drawings and the following detailed description of an embodiment thereof.

BRIEF DESCRIPTION OF THE DRAWINGS

FIG. 3 is a horizontal section on the line 3—3 of FIG. 1, showing the offsetting drive;

FIG. 3*a* is a vertical section on the line 3*a*—3*a* of FIG. 3;

FIG. 3*b* is a fragmentary detail showing the registration of a set of sheets in the stapler;

DESCRIPTION OF THE PREFERRED EMBODIMENT

Figure 1:
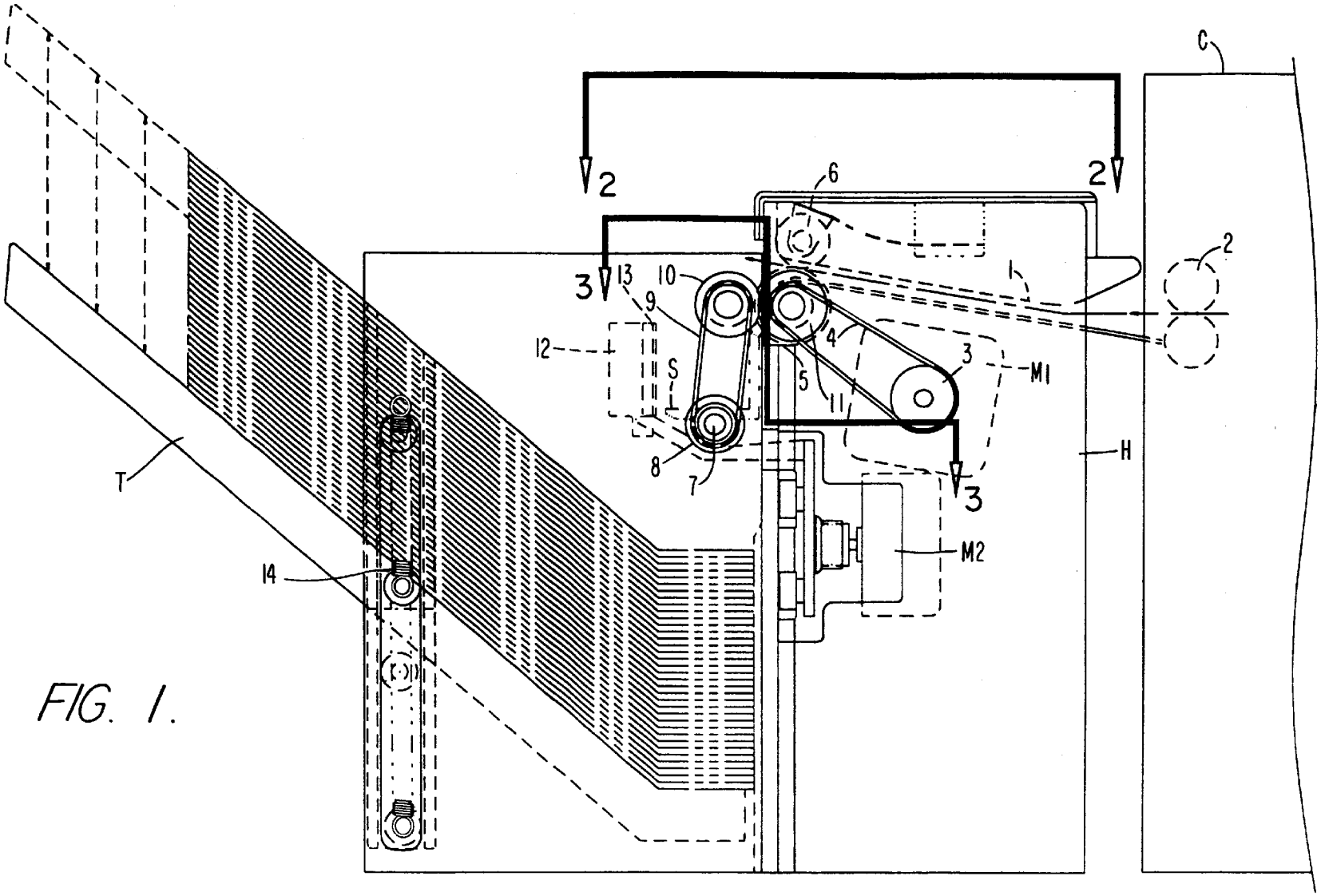
FIG. 1 is a side view with the cover removed, showing a finishing apparatus incorporating the invention.

Referring to FIG. 1, the apparatus includes a housing H having an inlet 1 for receiving sheets supplied thereto from feed rollers 2 of a copy making machine C, such as a copier or printer of types well known in the art.

It is, according to the objects of the invention, desired that sheets be supplied through the inlet and the transport by a sheet feeding system including a motor M1 which drives a pulley 3 and a belt 4, which in turn drives a driven roll 5 engaged with an idler roll 6. In this way, as shown by the broken arrow, sheets may be fed from the reproduction machine such that the leading ends of the sheets will be deposited lead end first on top of a stack of sets of sheets SS on an upwardly extended stacker tray T.

The trailing ends of the sheets, as the trailing ends leave the sheet transport, will fall downwardly onto a shelf S shown in broken lines in FIG. 1, but in full lines in FIGS. 2, 3, 7 and 8. The shelf is formed substantially at a right angle and at one end has a pin 7 extending therefrom and supporting a one way clutch 8 driven by a belt 9 and a gear 10 which, in mesh with a gear 11, drives the sheet infeed roll 5.

In a manner which will be described later, the shelf S is adapted to be dumped or tilted in a counterclockwise direction while the clutch idles until such time as the motor M1 is reversed to apply counterclockwise rotation to the clutch pin 7. In lieu of a one-way clutch, a simple motor may be employed to dump the shelf.

Also in a manner which will be later described means are provided for aligning and offsetting the sheets before they are dropped from the shelf S, including an aligner arm 12 and an opposing registration arm 13 adapted to be driven towards and away from one another by the aligner motor M2 and the registration motor M3.

As will later be described or become apparent, the stacker tray T is adapted to receive sets of sheets of paper, as the leading ends and trailing ends are supported respectively, either on the sheet set SS previously deposited on the tray or on the tray T and the trailing ends are supported on the shelf S until the shelf is tilted in a counterclockwise direction to drop the sheet sets SS onto the set below or onto the tray T. As the progressing weight of the sets of sheets in increased, the weight is offset by a counterbalance spring 14 located at the respective opposite sides of the supporting frame 15 and adapted to maintain an upward spring force on the tray T as the tray moves between the empty tray position, shown in broken lines, and the full tray position, shown in full lines in FIG. 1.

In the case that the apparatus is adapted to staple together sets of sheets, a stapling type finisher F is located at one side of the apparatus and disposed with respect to a support 20 so as to be located at an appropriate angle for stapling sets of sheets. The stapler may be disposed with a throat causing the staple to be driven into either side of the set of sheets, depending upon the order in which the sheets exit the printing device.

The aligner means, which is best illustrated in FIG. 3*a*, includes an endless belt 30 driven by the motor M2 connected to endless belt 30 at 31 so as to be translated towards and away from the registration member 13. So as to move the aligning member 12 transversely of the apparatus is an aligner plate 32 movable on bearings 33 and to which the aligner arm 12 is attached or made a part.

The aligner member arm 12, in response to reversible drive of the motor M2, is movable between the full line position of FIG. 3 and the broken line position as indicated by the arrow 34.

Figure 2:
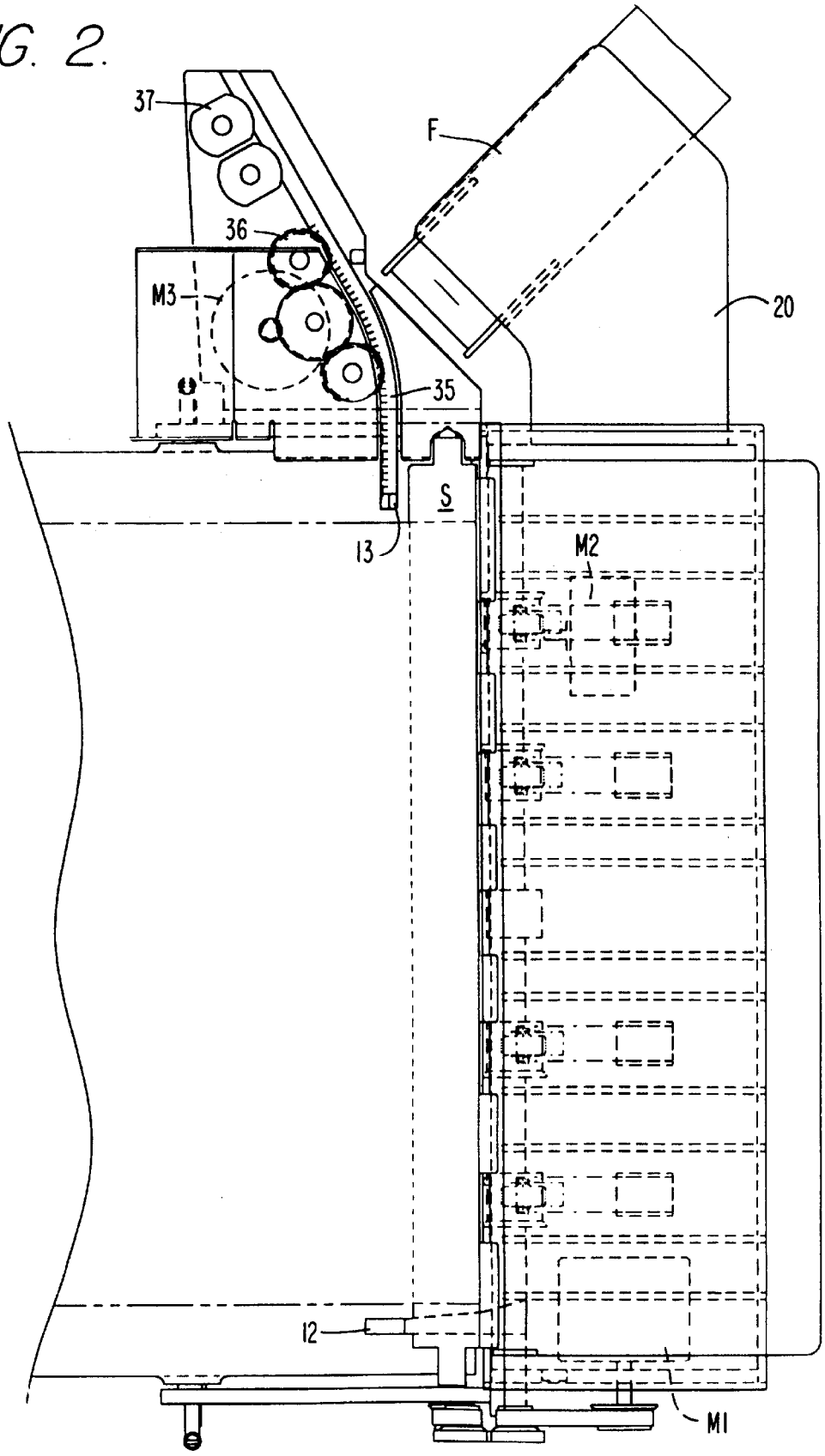
FIG. 2 is a horizontal section on the line 2—2 of FIG. 1.

The registration member 13 is connected to or formed upon a flexible plastic rack 35, as best seen in FIG. 2 and is driven by the motor M3 through a gear train 36, including pinions. The rack 35 is suitably held in a track by rack hold-downs 37.

The purpose of utilizing a flexible rack is to enable the rack to be suitably positioned forwardly, in a sheet feeding direction, so as to not interfere with positioning of the stapler, while enabling the sets of sheets to be moved transversely into the throat of the stapler at a position in close proximity of the shelf S, on which the trailing ends of the sets of sheets are collected.

Figure 4:
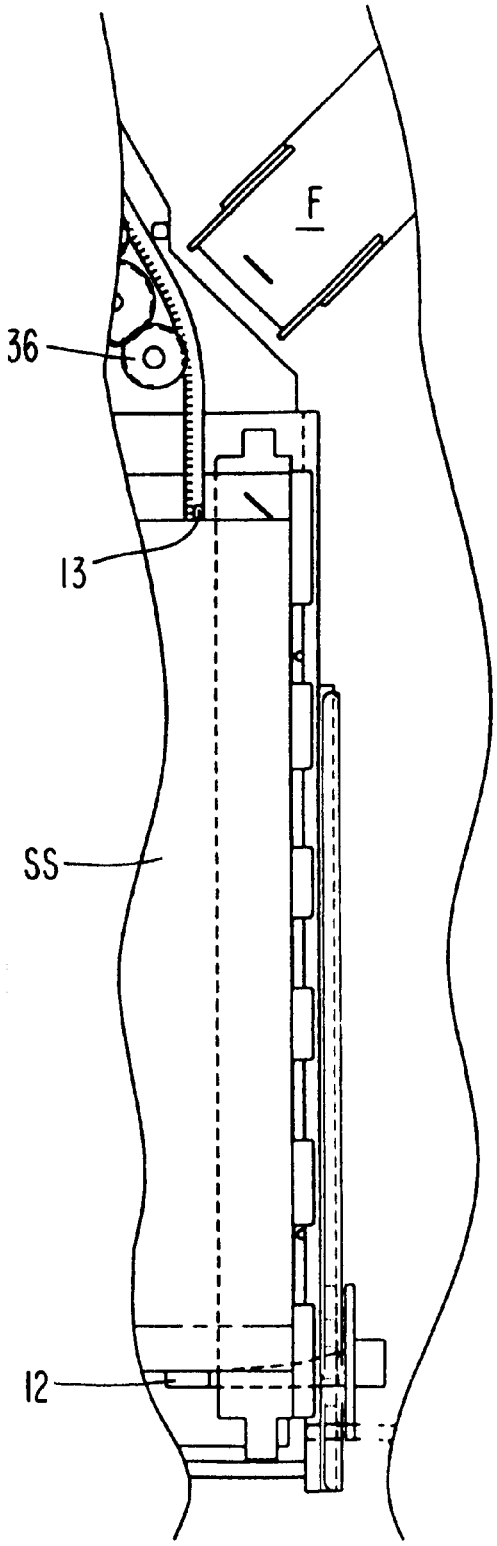
FIG. 4 is a horizontal view showing a set of sheets being aligned above a previously stapled set.
Figure 5:
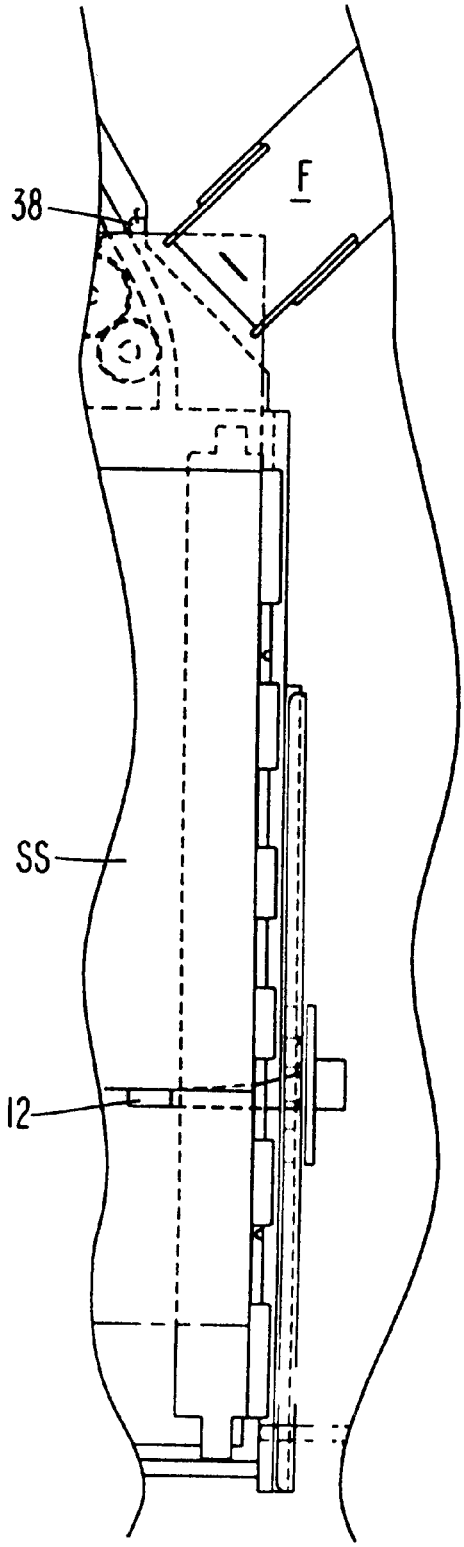
FIG. 5 is a view like FIG. 4 showing the top set of FIG. 4 moved into the stapler.
Figure 6:
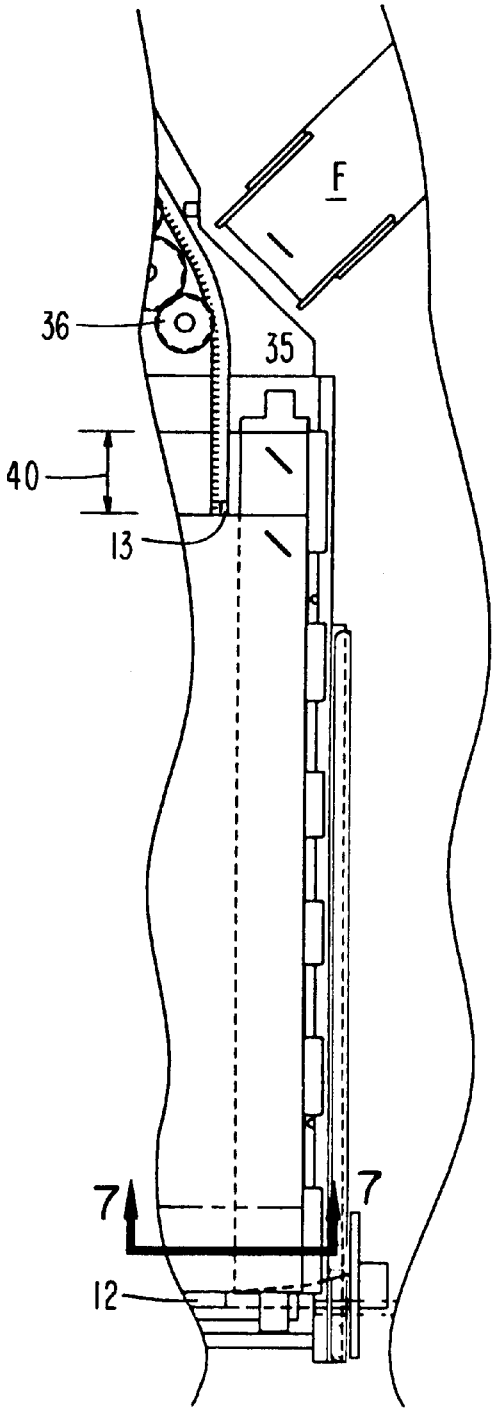
FIG. 6 is a progressive view showing the top set moved to a position offset from the lower set.

Referring now to FIGS. 4, 5 and 6 it will be seen that suitable means are provided for controlling the motors M2 and M3 and positioning the aligner arm 12 relative to the registration member 13.

In FIG. 4, it will be seen that as the set of sheets SS is being collected they are jogged laterally with respect to the infeed direction between the aligner arm 12 and the registration member 13 by the relative position of these two members.

In FIG. 5, it will be seen that the aligning member 12 has been moved towards the stapler F and the registration member 13 has been moved in the direction to permit the sheets SS to have their upper edge (as seen in FIG. 5) engaged with a fixed registration post 38 at the staple and so that the corner of the set of sheets is disposed in the stapler for driving a staple.

As seen in FIG. 6, the rack 35 has been extended and the alignment arm 12 has been retracted. The extent of extension and retraction of the registration member and the aligner arm provides an offset equal to the arrow 40 in FIG. 6 between the stapled sets.

The alignment and registration members are close to and move relative to the horizontal edge of the shelf. The stapler occupies space at the end of the shelf, so that the flexible rack allows the registration mechanism to function in the space normally occupied by the stapler during corner stapling. However, movement of the rack through an arc, from the position of the rack drive forwardly of the rack provides the stapler space.

Figure 7:
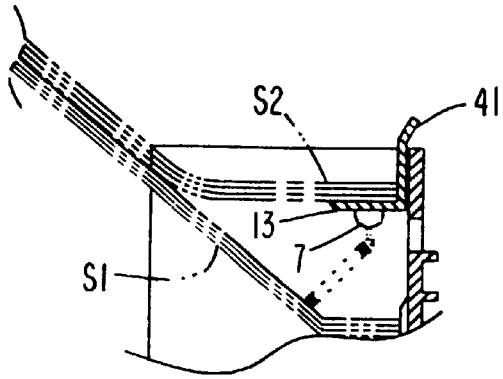
FIG. 7 is a fragmentary section showing the shelf in a set receiving position.

Referring to FIG. 7, a detail is shown in which the trailing ends of the set of sheets S1 is disposed at its trailing end against a back stop wall 41, while the set of sheets are accumulated on the shelf S and supported on the set S1 at the leading ends of the set while the trailing ends of the set are supported on the shelf, and the shelf is in its normal position about its pivot 7 under the influence of the spring.

Figure 8:
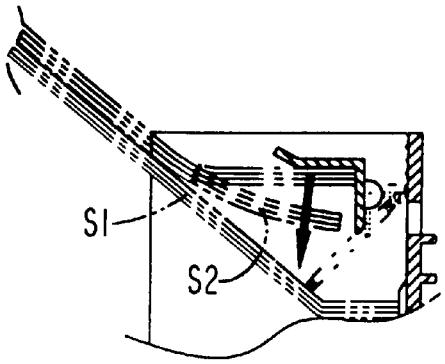
FIG. 8 shows the shelf dropped to release the set.

On the other hand, as seen in FIG. 8, responsive to the one way clutch mechanism, as seen above, the shelf S is caused to dump, so that the trailing ends of the set are being released for deposit on the set S1.

Having thus described an illustrative embodiment, what is claimed as the invention is defined in the appended claims:

What is claimed is:

1. Set finishing and stacking apparatus comprising: means providing a sheet assembly station for receiving sheets fed into the apparatus, a finishing station, stacker means associated with said finishing station, said finishing station including means for stapling sets of sheets, and said assembly station including a pivoted shelf for receiving the trailing ends of sheets supplied thereto to form a set with the leading ends of said sheets supported on said stacker or previous set of sheets, means for pivoting said shelf to drop said trailing ends of said sets of sheets towards said stacker means, and means for returning said shelf to a sheet receiving position.

2. Set finishing and stacking apparatus as defined in claim 1, wherein said apparatus also includes means for side edge alignment of said sheets while supported on said shelf.

3. Set finishing and stacking apparatus as defined in claim 1, wherein said apparatus also includes means for side edge alignment of said sheets while supported on said shelf, and means for offsetting the stapled sets of sheets.

4. Set finishing and stacking apparatus as defined in claim 1, wherein said apparatus also includes means for side edge alignment of said sheets while supported on said shelf, and said means for stapling is disposed at one side of said apparatus, said side edge aligning means moving the unstapled set of sheets into the means for stapling said set.

5. Set finishing and stacking apparatus as defined in claim 1, including another fixed set registration member which determines the location of the set in the means for stapling said set.

6. Set finishing and stacking apparatus as defined in claim 1, wherein said registration member is movable relative to the alignment means to position the sets in offset relationship.

7. Set finishing and stacking apparatus as defined in claim 1, wherein means are provided for dropping said shelf.

8. Set finishing and stacking apparatus as defined in claim 7, including a spring for returning said shelf to a sheet receiving position.

9. Set finishing and stacking apparatus as defined in claim 1, including side edge alignment means movable towards said means for stapling sets of sheets, registration means engageable by the sheets in said sets and retractable to allow a set of sheets to be moved by said side edge alignment means into said means for stapling sets and extensible to return the stapled set to a position on said shelf offset from a previously stapled set of sheets on said stacker means.

10. Set finishing and stacking apparatus as defined in claim 9, including means for retracting and extending said registration means including a flexible rack, a pinion engaged with said rack for moving said rack, and means for driving said pinion in opposite directions.

11. Set finishing and stacking apparatus as defined in claim 9, including means for moving said side edge alignment means as aforesaid.

12. Set finishing and stacking apparatus as defined in claim 1, including side edge alignment means movable towards said means for stapling sets of sheets, registration means engageable by the sheets in said sets and retractable to allow a set of sheets to be moved by said side edge alignment means into said means for stapling sets and extensible to return the stapled set to a position on said shelf.

13. Set finishing and stacking apparatus as defined in claim 12, including means for retracting and extending said registration means including a flexible rack, a pinion engaged with said rack for moving said rack, and means for driving said pinion in opposite directions.

14. Set finishing and stacking apparatus as defined in claim 12, including means for moving said side edge alignment means as aforesaid.

* * * * *